US005235395A

United States Patent [19]

Ishiwata

[11] Patent Number: 5,235,395

[45] Date of Patent: Aug. 10, 1993

[54] IMAGE FIXING APPARATUS

[75] Inventor: Kazuhiko Ishiwata, Tokyo, Japan

[73] Assignee: Canon Kabushiki Kaisha, Tokyo, Japan

[21] Appl. No.: 560,760

[22] Filed: Jul. 31, 1990

[30] Foreign Application Priority Data

Aug. 1, 1989 [JP] Japan ..... 1-199653

[51] Int. Cl.[5] ..... G03G 15/20

[52] U.S. Cl. ..... 355/285; 219/216; 355/290

[58] Field of Search ..... 474/102, 106, 107, 101, 474/140; 355/285, 289, 290, 282; 219/216; 162/205, 206; 198/832-835, 840

[56] References Cited

U.S. PATENT DOCUMENTS

| | | | |
|---|---|---|---|
| 2,655,252 | 10/1953 | Spurgeon | 474/107 X |
| 3,525,787 | 8/1970 | McDermott | 162/206 X |
| 3,811,828 | 5/1974 | Ohta et al. | 219/216 X |
| 4,003,783 | 1/1977 | Groome et al. | 162/206 X |
| 4,170,175 | 10/1979 | Conlon, Jr. | 474/107 X |
| 4,171,044 | 10/1979 | Rossio | 198/834 |
| 4,287,021 | 9/1981 | Justus et al. | 162/205 X |
| 4,568,779 | 1/1986 | Coli et al. | 355/212 |
| 4,954,845 | 9/1990 | Yano et al. | 355/290 |

FOREIGN PATENT DOCUMENTS

| | | |
|---|---|---|
| 0181723 | 5/1986 | European Pat. Off. . |
| 0372558 | 6/1990 | European Pat. Off. . |
| 2049293 | 10/1970 | Fed. Rep. of Germany . |

OTHER PUBLICATIONS

European Patent Application #295,901; Hirabayashi et al.; Dec. 21, 1988.

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image fixing apparatus includes a heater; an endless film movable together with a supporting member for supporting a toner image, in which the toner image is heated by heat from the heater through the film; a driver for driving the film; and a limiter for limiting the lateral position of the film. At least a part of the endless film is limited by the limiter and is substantially tension-free when the film is driven.

21 Claims, 2 Drawing Sheets

IMAGE FIXING APPARATUS

FIELD OF THE INVENTION AND RELATED ART

The present invention relates to an image fixing apparatus for fixing an unfixed toner image on a recording material, usable with an image forming apparatus such as a copying machine or photoprinter.

In a widely used conventional image fixing apparatus wherein the toner image is fixed on the recording medium supporting an unfixed toner image, the recording medium is passed through a nip formed between a heating roller maintained at a predetermined temperature and a pressing or back-up roller press-contacted to the heating roller. In the heat-roller type fixing system, the surface temperature of the heating roller has to be maintained correctly at a predetermined level in order to prevent the tone offset by the variation in the temperature. In order to accomplish this, the heating roller is required to have sufficient thermal capacity, with the result that the waiting period (warming period) is long until the fixable temperature of the heating roller surface is reached.

U.S. Pat. Nos. 4,954,845; 4,998,121; 4,985,603; 5,026,276; 5;027,160; 5,179,263 and U.S. Pat. Ser. Nos. 206,767; 409,431; 435,427; 440,380; 444,802 and 469,957 propose an image fixing apparatus having a fixed heater and a heat-resistive fixing film in sliding contact with the heater, wherein the toner image is fused through the film. This proposal makes it possible to significantly reduce or eliminate the warm-up time.

In this type of the fixing apparatus, the fixing film is tensioned at its entire circumference by a driving roller and/or a tension roller. Therefore, the driving torque required for driving the film is large. In addition, there is a problem that the endless film shifts in the lateral direction, that is, the direction perpendicular to the direction of the travel thereof.

The lateral shifting can be suppressed to a certain degree by adjusting the distance between rollers and the tension and by increasing the cylindrical accuracy of the film. However, from the standpoint of mass-production, there is a practical limit, and therefore, it cannot completely be eliminated.

In order to prevent the lateral shift of the film, it is considered that the lateral ends of the film is forcedly guided. However, if this is done, the lateral ends of the film may be damaged since the rigidity of the film is not large when the lateral shifting force is large.

SUMMARY OF THE INVENTION

Accordingly, it is a principal object of the present invention to provide an image fixing apparatus wherein the fixing film can be driven with a small driving torque.

It is another object of the present invention to reduce the lateral shifting force so that the lateral ends of the film are not easily damaged.

It is a further object of the present invention to provide an image fixing apparatus wherein at least a part of the endless film is not taut.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
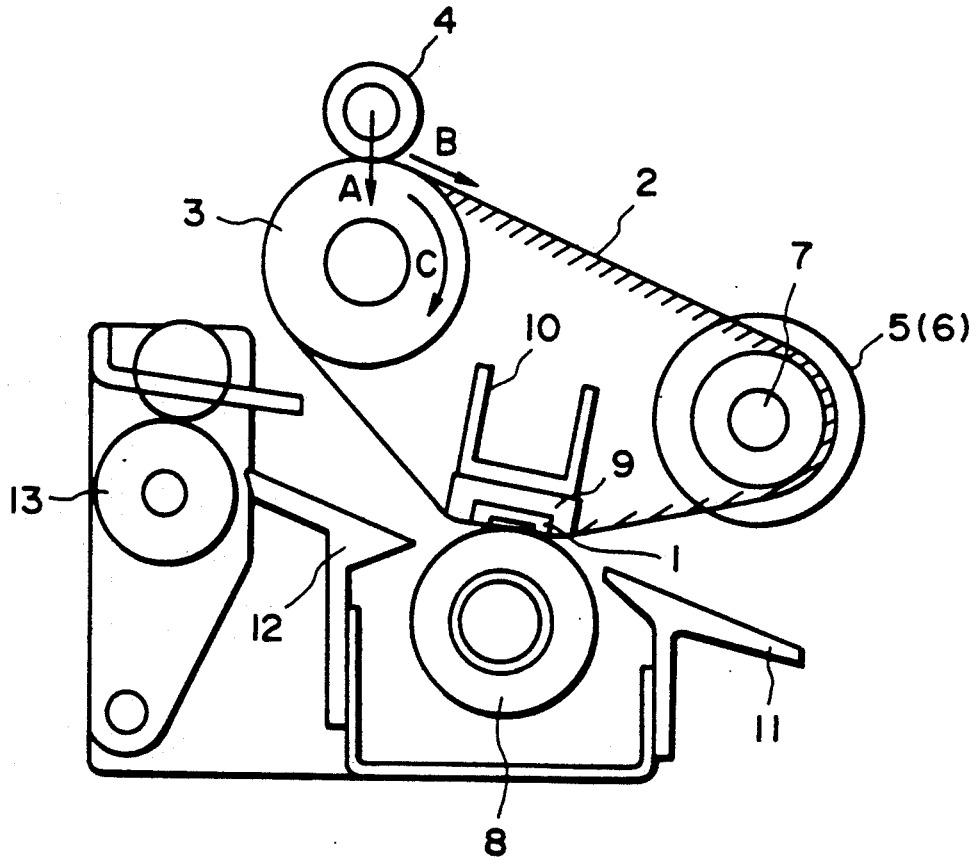
FIG. 1 is a sectional view of an image fixing apparatus according to an embodiment of the present invention.
Figure 2:
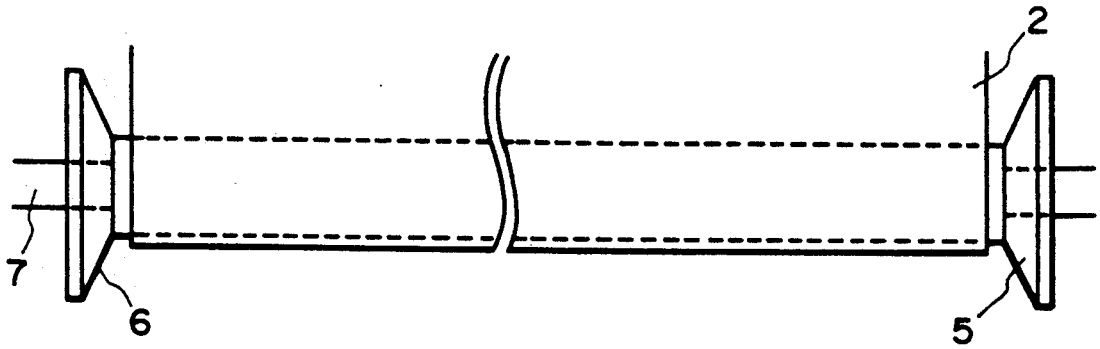
FIG. 2 is a top plan view of a part of the apparatus of FIG. 1.
Figure 3:
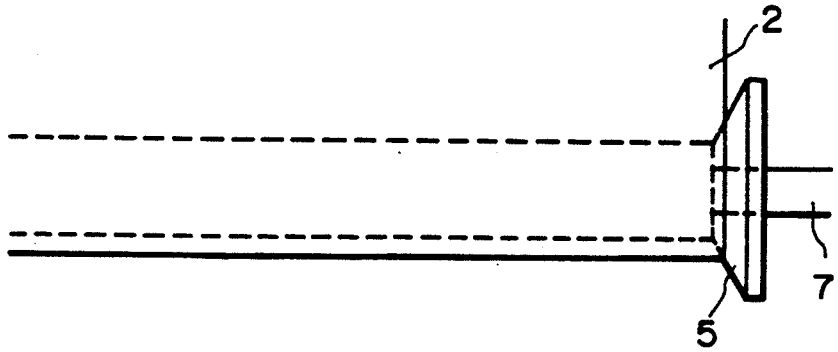
FIG. 3 is a partial top plan view illustrating the limitation to the lateral shift in the apparatus of FIG. 1.

Referring to FIGS. 1, 2 and 3, the preferred embodiment of the present invention will be described. FIG. 1 is a sectional view of an image fixing apparatus according to this embodiment, which comprises a heater 1 having a heat generating resistor layer generating heat upon electric energization and having a high thermal conductivity, and a fixing film 2. The fixing film 2 has a total thickness which is preferably not more than 50 microns. The apparatus further comprises a driving roller 3 and a pressing roller 4 press-contacted to the driving roller 3 to drive the fixing film 2. Limiting guides 5 and 6, as shown in FIG. 2, too, function to limit the lateral ends of the fixing film 2. The guides 5 and 6 are supported on the guiding shaft 7. The fixing film 2 is stretched between the driving roller 3 and the guiding shaft 7 to provide a film conveying path together with the heater 1. The fixing film 2 is conveyed in a direction indicated by an arrow B by being urged to the driving roller 3 by urging the press-contact roller 4 in the direction A by an unshown urging means.

The driving roller 3 includes a core metal made of steel or the like coated with silicone rubber layer or the like to assure the conveyance of the fixing film 2. The press-contact roller 4 is supported by an unshown bearing to rotate following the fixing film 2.

A pressing roller 8 has a rubber elastic layer made of silicone rubber or the like exhibiting good parting properties, and functions to urge the fixing film 2 to the heater 1 to provide the force required for executing the image fixing action. Opposite ends of the pressing roller 8 are supported by an unshown bearing to rotate following the fixing film 2. The heater 1 is fixed on a stay 10 having sufficient rigidity against the pressing force, through an insulating member 9 having a low thermal conductivity made of heat resistive resin or the like.

Designated by reference numerals 11, 12 and 13 are an inlet guide, a separation guide and a discharging roller, respectively.

The recording material carrying an unfixed image made of toner powder is introduced along the inlet guide 11 and is further introduced into the nip formed between the fixing film 2 and the pressing roller 8. The toner image on the recording material is heated and fused by the heat and pressure applied by the heater and the pressing roller 8, and is fixed on the recording material. The recording material is discharged to the outside of the apparatus by the discharging roller 13 through the separation guide 12 without crease or jam.

As shown in FIG. 1, when the driving roller 3 rotates in the direction C, the fixing film is conveyed in the direction B with the aid of the press-contact force by the pressing roller 4, and the pressing roller 8 rotates following the fixing film 2.

The fixing film 2 is stretched around the heater 1, the driving roller 3 and the limiting guide 7 with slight play. Therefore, during the film driving operation by the driving roller 3 and the pressing roller 4, no tension is applied to the hatched portion of the fixing film 2. Therefore, even if the fixing film 2 is laterally shifted, the lateral shifting force which is proportional to the tension of the fixing film 2, is very small in this portion. Therefore, even if the lateral ends of the thin fixing film 2 are limited forcedly by the limiting guides 5 and 6, the ends of the film are not damaged.

FIG. 2 is a plan view as seen from upper right of FIG. 1 to illustrate the positional relationship between the fixing film 2 and the limiting guides 5 and 6. The distance between the limiting guides 5 and 6 is slightly larger than the width of the fixing film 2. The limiting guides 5 and 6 are freely rotatable relative to the shaft 7. The limiting guides 5 and 6 have a diameter increasing toward the outside, so that when the fixing film 2 is laterally shifted to be contacted to the limiting guide 5 or 6, the lateral ends of the film is prevented from being damaged Assuming that the fixing film is driven and that it is laterally shifted toward right, the limiting guide 5 rotates together with the fixing film 2 when the fixing film 2 is brought into contact with the limiting guide 5, then, as shown in FIG. 3, the equilibrium is reached when the end of the fixing film slightly rises on the limiting guide 5, upon which the lateral shift stops. Similarly, when it shifts laterally toward left, the equilibrium is reached when it slightly rises on the limiting guide 6, upon which the lateral shift of the fixing film 2 stops.

As described hereinbefore, the heat-resistive and endless fixing film 2 stretched around one or more rollers is press-contacted to the driving roller 3 by the pressing roller 4, by which the driving force is applied to the fixing film 2, while preventing a part of the fixing film 2 (hatched portion in FIG. 1) is not taut. Therefore, the driving torque required for moving the fixing film can be reduced.

In addition, the lateral shift of the fixing film 2 can be controlled by a simple mechanism using the limiting guides 5 and 6 at the opposite ends.

Figure 4:
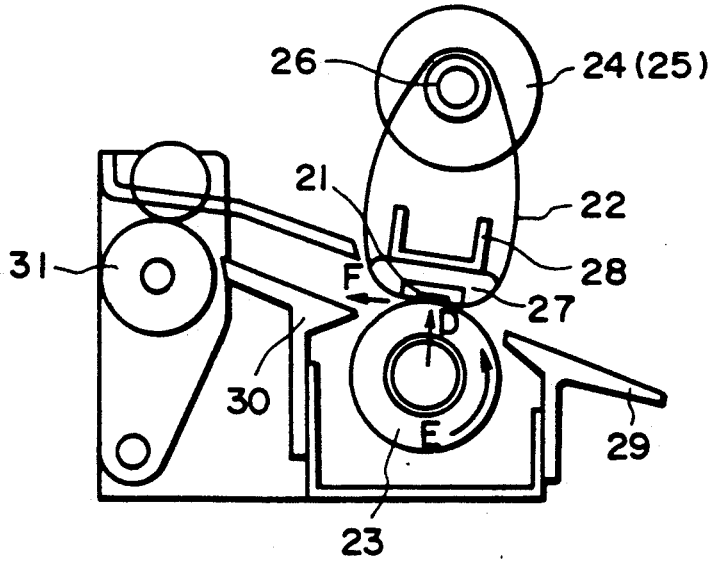
FIG. 4 is a sectional view of the apparatus according to another embodiment of the present invention.

Referring to FIG. 4, another embodiment of the present invention will be described. The image fixing apparatus comprises a heater 21 and a fixing film 22. Similarly, the fixing film 22 is in the form of a thin endless film made of heat-resistive resin coated, at its one side, with a parting layer made of PTFE resin or fluorinated resin. It further comprises a driving roller 23 functioning also as a pressing roller, which comprises a rubber elastic layer made of silicone rubber or the like exhibiting good parting properties. It press-contacts the fixing film 22 to the heater 21 in the direction indicated by an arrow D by an unshown pressing means to provide the force required for the fixing action. Limiting guides 24 and 25 function to limit the lateral ends of the fixing film 22, similarly to the limiting guides 5 and 6 in FIG. 2. The limiting guides 24 and 25 are supported on a guiding shaft 26, similarly to the guiding shaft 7 in FIG. 2. The limiting guides 24 and 25 are spaced apart from each other by a distance which is slightly larger than the width of the fixing film 22. The limiting guides 24 and 25 are freely rotatable. The heater 21 is fixed on a stay 28 having a sufficient rigidity against the pressure force, through an insulating member 27 made of heat resistive resin. Designated by reference numerals 29, 30 and 31 are an inlet guide, a separation guide and a discharging roller, respectively.

The fixing film 22 is stretched around the guiding shaft 26 and the heater 21 with small play.

When the driving roller functioning as the pressing roller driven by a driving force from an unshown driving source, rotates in the direction E, the fixing film 22 is moved in the direction F with the aid of the pressing force to the heater 21. At this time, the fixing film 22 is confined only at the driving portion (the portion sandwiched by the driving roller 23 and the heater 21), and all the rest portion is free from the tension force. Therefore, even if the lateral shift occurs, the lateral shifting force is very small. For this reason, it is possible to limit the lateral ends of the fixing film 22 forcedly by the limiting guides 24 and 25.

Similarly to the first embodiment, the diameter of the limiting guide 24 or 25 has a diameter increasing toward the outside. Therefore, when the fixing film 22 laterally shifts to be contacted to the limiting guide 24 or 25, the limiting guide 24 or 25 rotates together with the fixing film 22, until the equilibrium is reached, upon which the lateral shift stops.

Therefore, the toner image is properly fixed on the recording material, and the recording material is discharged, without production of crease or occurrence of jam.

As described in the foregoing, the fixing film is moved by driving the rotatable pressing member for forming the nip, disposed outside the endless film, by which the portion at which the tension is applied is limited to the nip, so that the driving torque required for the traveling of the endless film can be significantly reduced.

In addition, the lateral shifting force is significantly reduced, and therefore, the limiting action at the lateral end of the film can be effected safely.

Since the number of rollers required for driving the fixing film 22 can be reduced, so that the size of the image fixing apparatus can be reduced, and the apparatus can be easily assembled.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heating member;

an endless film movable together with a supporting member for supporting a toner image, wherein the toner image on said supporting member is heated by heat from said heating member through said film;

a pressing rotatable member for forming a nip between said film and said pressing rotatable member for urging said film to said heater member, wherein said film receives a driving force only from said pressing rotatable member; and a limiting member against which said film abuts at a position different from said nip to limit lateral shifting of said film.

2. An apparatus according to claim 1, further comprising a guide for guiding said film, and wherein said film is in the form of an endless belt, and said film is trained around said heating member and said guide with slackness.

3. An apparatus according to claim 1, wherein said rotatable driving member is a roller having a rubber layer.

4. An apparatus according to claim 1, wherein said heating member has a heater which is stationary in use and said film slides on said heater.

5. An apparatus according to claim 4, wherein said heater extends in a direction crossing with a direction of movement of said film and has a heat generating resistor generating heat upon electric energization.

6. An apparatus according to claim 5, wherein no air layer exists between said heat generating resistor and the toner image.

7. An image fixing apparatus, comprising:

heating means;

an endless film movable together with a supporting member for supporting a toner image, wherein the toner image is heated by heat from said heating means through said film;

driving means for rotating said film; and limiting means for limiting a lateral position of at least a portion of said film by abutment of a lateral end of said film thereto, wherein said at least a portion of said film is substantially tension-free.

8. An apparatus according to claim 7, wherein said limiting means has a limiting guide having a diameter continuously increasing toward an outside.

9. An apparatus according to claim 7, wherein said limiting means has limiting members at opposite ends of said film.

10. An apparatus according to claim 7, wherein said heating means has a heater which is stationary in use, and said film slides on said heater.

11. An apparatus according to claim 10, wherein said heater extends in a direction crossing with a direction of movement of said film and has a heat generating resistor generating heat upon electric energization.

12. An apparatus according to claim 11, wherein no air layer exists between said heat generating resistor and the toner image.

13. An apparatus according to claim 7, further comprising a pressing member for urging together said heating means, said film and the image supporting member.

14. An image forming apparatus, comprising:

heating means;

an endless film movable together with a supporting member for supporting a toner image, wherein the toner image is heated by heat from said heating means through said film;

driving means for rotating said film; and a limiting means for limiting a lateral position of a portion of said film wherein said limiting means is actable on the portion of said film where its tension is at its substantial lowest.

15. An apparatus according to claim 14, wherein no tension is applied to said film at said portion during driving of the film.

16. An apparatus according to claim 14, wherein said limiting means has a limiting guide having a diameter continuously increasing toward its outside.

17. An apparatus according to claim 14, wherein said limiting means has limiting members at opposite ends of said film.

18. An apparatus according to claim 14, wherein said heating means has a heater which is stationary in use, and said film slides across said heater.

19. An apparatus according to claim 18, wherein said heater extends in a direction crossing with a direction of movement of said film and has a heat generating resistor generating heat upon electric energization.

20. An apparatus according to claim 19, wherein no air layer exists between said heat generating resistor and the toner image.

21. An apparatus according to claim 14, further comprising a pressing member for urging together said heating means, said film and the image supporting member.

* * * * *

UNITED STATES PATENT AND TRADEMARK OFFICE

CERTIFICATE OF CORRECTION

PATENT NO. : 5,235,395
DATED : August 10, 1993
INVENTOR(S) : Kazuhiko Ishiwata

It is certified that error appears in the above-indentified patent and that said Letters Patent is hereby corrected as shown below:

On the title page: Item

[56] References Cited

U.S. PATENT DOCUMENTS

"4,568,779" should read --4,566,779--.

Column 1

Line 20, "tone" should read --toner--;
Line 27, "5;027,160;" should read --5,027,160;--; and
Line 48, "is" should read --are--.

Column 3

Line 22, "damaged" should read --damaged.--.

Column 4

Line 58, "heater" should read --heating--.

Signed and Sealed this

Sixth Day of June, 1995

Bruce Lehman

*Attest:*

BRUCE LEHMAN

*Attesting Officer*

*Commissioner of Patents and Trademarks*